United States Patent [19]

Forsberg et al.

[11] 4,161,990

[45] Jul. 24, 1979

[54] ROCK DRILLING APPARATUS

[75] Inventors: Bo E. Forsberg, Vällingby; Carl G. B. Ekwall, Saltsjöbaden, both of Sweden

[73] Assignee: Atlas Copco Aktiebolag, Nacka, Sweden

[21] Appl. No.: 847,043

[22] Filed: Oct. 31, 1977

[30] Foreign Application Priority Data

Nov. 4, 1976 [SE] Sweden ..... 7612275

[51] Int. Cl.[2] ..... B25D 9/00

[52] U.S. Cl. ..... 173/105; 173/112; 173/147; 173/152; 173/162 R

[58] Field of Search ..... 64/23.5; 173/104–113, 173/147, 152; 279/19, 19.1–19.7

[56] References Cited

U.S. PATENT DOCUMENTS

| | | | |
|---|---|---|---|
| 913,928 | 3/1909 | Traylor | 173/108 |
| 1,116,139 | 11/1914 | Sherwood | 173/106 |
| 1,793,868 | 2/1931 | Pearson | 279/19.5 |
| 2,268,572 | 1/1942 | Curtis | 173/147 X |
| 2,673,071 | 3/1954 | Curtis et al. | 173/147 X |
| 2,767,957 | 10/1956 | Feucht | 173/133 |
| 2,819,042 | 1/1958 | Feucht | 173/147 X |
| 3,498,390 | 3/1970 | Salmi | 173/105 |
| 3,892,107 | 7/1975 | Handen et al. | 173/104 X |
| 3,918,535 | 11/1975 | Eklof et al. | 173/105 X |
| 4,068,727 | 1/1978 | Andersson et al. | 173/1 |

FOREIGN PATENT DOCUMENTS

| | | | |
|---|---|---|---|
| 928702 | 6/1955 | Fed. Rep. of Germany | 173/147 |
| 2401891 | 7/1975 | Fed. Rep. of Germany | 279/19 |

*Primary Examiner*—Lawrence J. Staab
*Attorney, Agent, or Firm*—Frishauf, Holtz, Goodman and Woodward

[57] ABSTRACT

A rock drill is mounted on a cradle that is axially displaceably mounted on a feed beam. The drill has a front aperture for receiving the rear end of a drill string. The drill string is freely insertable into and retractable out of a rotation transmitting wear bushing in the aperture, and a drill string retainer is mounted on the cradle. The wear bushing is also freely retractable out of the drill, and it is also held in position by the drill string retainer. The rear end of the drill is mounted to the cradle by means of a hinge connection so that the front end of the drill can be swung up when the wear bushing is to be replaced.

12 Claims, 9 Drawing Figures

ROCK DRILLING APPARATUS

This invention relates to a rock drilling apparatus of the kind that comprises a hammer drill that is carried on a slide that is axially displaceable along a feed beam by means of a feed motor. According to the invention, the drill string is freely insertable into and retractable out of a front aperture of the drill and the slide is provided with a retainer for preventing the drill string from being pulled out of the drill.

DETAILED DESCRIPTION OF ILLUSTRATED EMBODIMENTS

Figure 1:
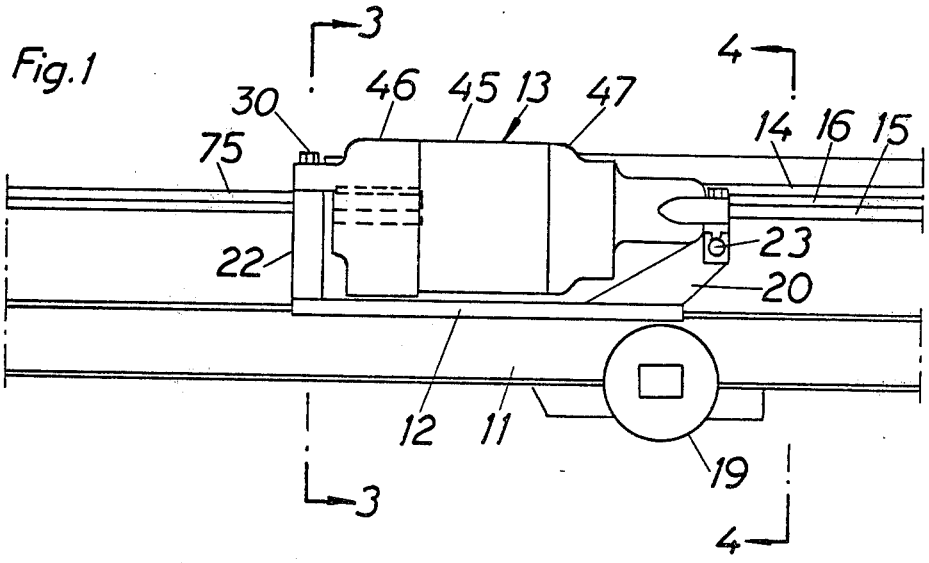
FIG. 1 shows in a side view a rock drill mounted on a feed beam.
Figure 2:
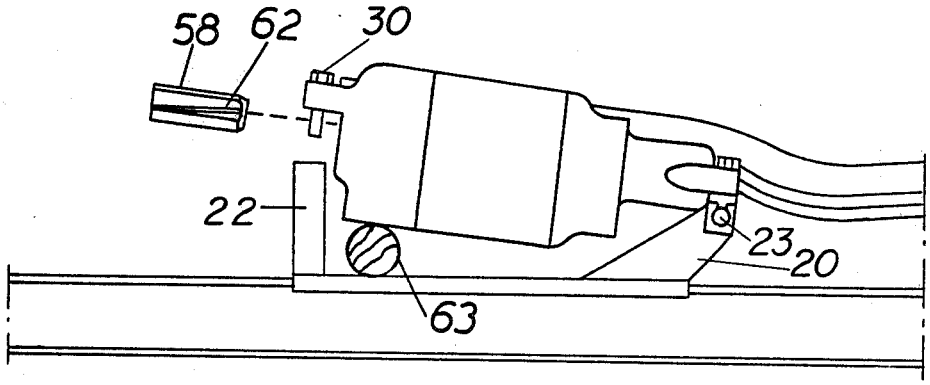
FIG. 2 is a side view corresponding to FIG. 1 but showing the rock drill swung up from the slide
Figure 3:
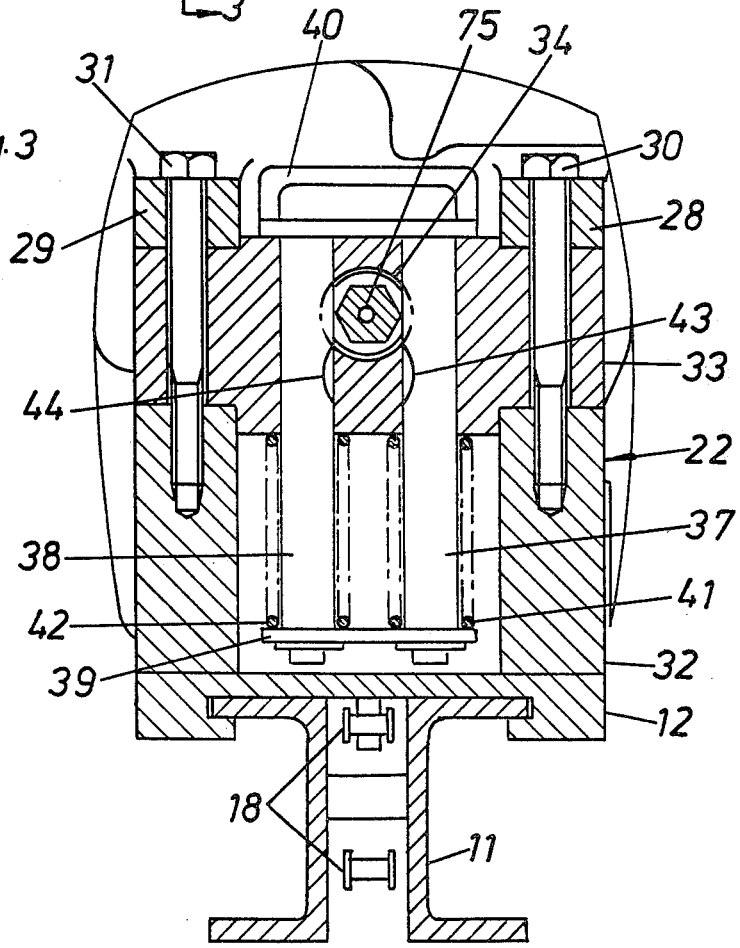
FIG. 3 is a cross section taken along line 3—3 in FIGS. 1 and 5.
Figure 4:
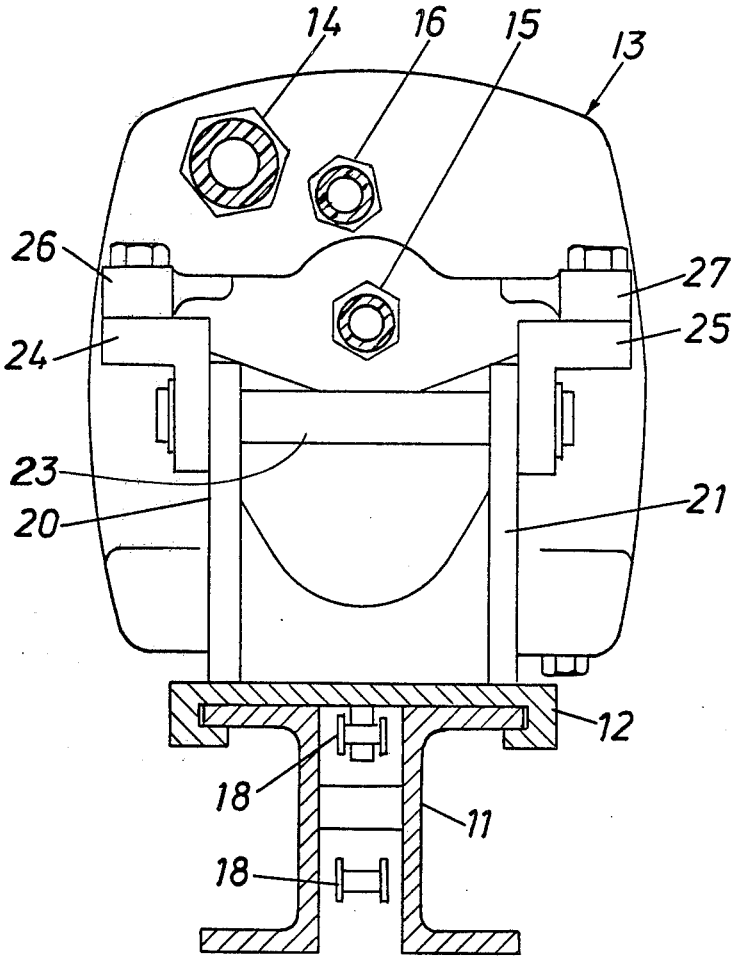
FIG. 4 is a cross section taken along line 4—4 in FIG. 1.

In FIG. 1 the middle portion of a feed beam 11 is shown. A slide or cradle 12 is mounted to be axially slidable along the feed beam. The slide 12 carries a compressed air operated hammer drill 13 that is supplied with drive fluid (compressed air), flush water and lubricating oil via three hoses 14,15,16. A feed chain 18 (FIG. 3) extends along the feed beam and is deviated on non-illustrated idling sprocket wheels at the ends of the feed beam. The two ends of the chain 18 are affixed to the slide 12. The chain is driven by a hydraulic motor 19 that can thus feed the slide in both directions along the feed beam. The rear end of the slide 12 has two upstanding brackets 20, 21 (FIGS. 1 and 4) and its front portion has a single upstanding bracket 22 (FIGS. 1 and 3). Through the brackets 20, 21 a shaft 23 extends freely rotatable. As seen in FIG. 4, on the shaft 23, there are two mounting members 24, 25 and the drill has two corresponding lugs 26, 27 that are screwed onto the mounting members 24, 25. The rear end of the drill is thus pivotably mounted on the slide by means of the hinge connection 20—25. As best seen in FIG. 3, the front portion of the drill has two lugs 28, 29 that are screwed to the bracket 22 by means of screws 30, 31. The bracket 22 comprises a fixed portion 32 and a detachable upper portion 33. The screws 30, 31 extend through the detachable portion 33 into the fixed portion 32 and holds the two portions together. The upper detachable portion 33 has a hole 34 for the drill rod 75 that in FIGS. 1–7 is shown as an integral drill steel with a collar 35 and a hexagonal shank 36. In the detachable portion 33 of the bracket 22 there are two rods 37, 38 slidable through bores. The rods 37, 38 are interconnected at their lower ends by means of a plate 39 and at their upper ends by means of a handle 40. Around the rods 37, 38 there are coil springs 41, 42 that hold the rods in their position shown in the figures. The rods 37, 38 form a retainer for the collar 35 (FIGS. 5 and 6) of the drill steel so that the drill steel cannot be pulled forwardly any further than to its position shown in FIG. 6. The rods 37, 38 have part circular recesses 43, 44 that permit the collar 35 to pass when the rods are lifted by means of the handle 40.

Figure 5:
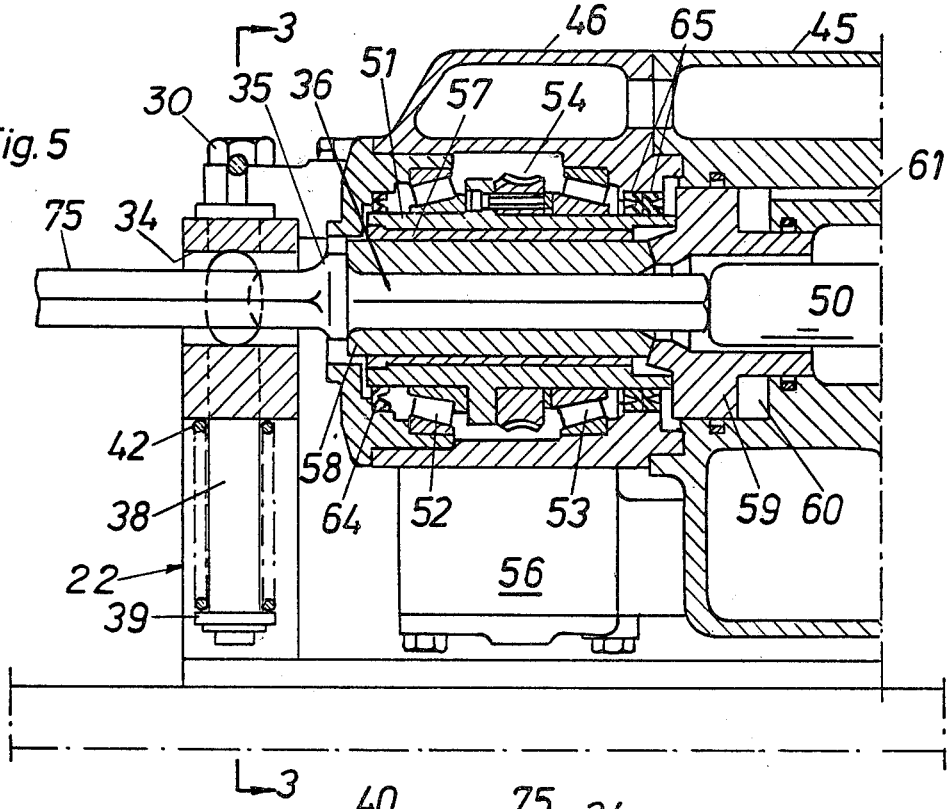
FIG. 5 is a longitudinal section through the front portion of the drill as it is shown in FIG. 1.

The housing of the drill comprises a middle portion 45 that contains the impact motor of the drill, a front portion 46 fastened by means of two screws 48, 49 to the middle portion 45 and a rear portion 47 which is also screwed to the middle portion. In FIG. 5, the front portion of the hammer piston 50 of the impact motor is shown in its position for impacting on the end face of the drill steel 75. In the front portion 45 of the housing there is a so called drill sleeve 51 that is rotatably mounted by means of two bearings 52, 53. A worm wheel 54 is screwed onto the drill sleeve 45. A worm screw 55 (FIG. 7) is in engagement with the worm gear 54 and the worm screw 55 is rotated by means of a reversible compressed air operated gear motor 56. The drill sleeve 51 has a lining in the form of a bronze bushing 57 that is affixed in the drill sleeve by means of a light press fit. The outer surface of the lining 57 has the form of a three-parted epitrochoid and its inner surface has a form somewhat modified from such a form.

Between the shank 36 of the drill steel and the lining 57 there is a wear bushing 58 of steel. It abuts axially rearwardly against an axially slidable and freely rotatable piston 59 that is actuated by the pressure in an air chamber 60 that is supplied with compressed air through a passage 61. The busing 58 forms a hexagonal aperture for receiving the shank 36 of the drill steel 75.

The feed force from the slide 12 is transmitted during drilling through the housing 45, 46, 47 of the drill and the air in the air chamber 60 to the piston 59 and from the piston 59 through the wear bushing 58 to the collar 35 of the drill steel as can be seen in FIG. 5.

Figure 6:
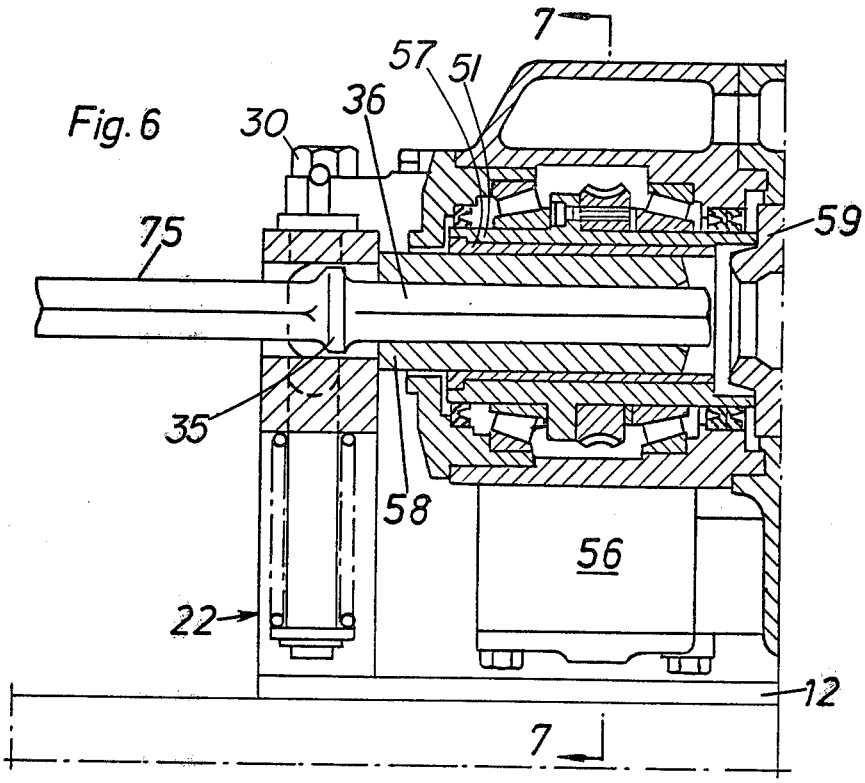
FIG. 6 is a longitudinal section corresponding to FIG. 5 but showing some details in other positions.

When the drill is moved backwardly by means of the feed motor 19, the collar 35 of a drill steel will instead be retained by the rods 37, 38 and the upper portion 33 of the bracket 22 will prevent the wear bushing 58 from falling out forwardly by forming an abutment for the forward end face of the bushing 58 as can be seen in FIG. 6.

Between the lining 57 of the drill sleeve and the wear bushing 58, three torque transmitting surfaces are formed and these surfaces are lubricated from oblique grooves 62 in the outer surface of the wear bushing 58. Since the surfaces between the lining 57 and the wear bushing 58 are large and well lubricated, they are not very heavily worn despite the combination of axial movement and torque transmission between the surfaces. The inner surface of the wear bushing 58 and the collar 36 of the drill steel is, however, subjected to considerable wear. When the wear bushing 58 needs to be replaced, the screws 30, 31 are unscrewed and the machine is swung up as shown in FIG. 2 and supported by means of for instance a piece of wood 63. The wear bushing 58 can now manually be taken out forwardly and the new bushing can be reinserted. The machine is then swung down and again screwed onto the bracket 22.

Figure 7:
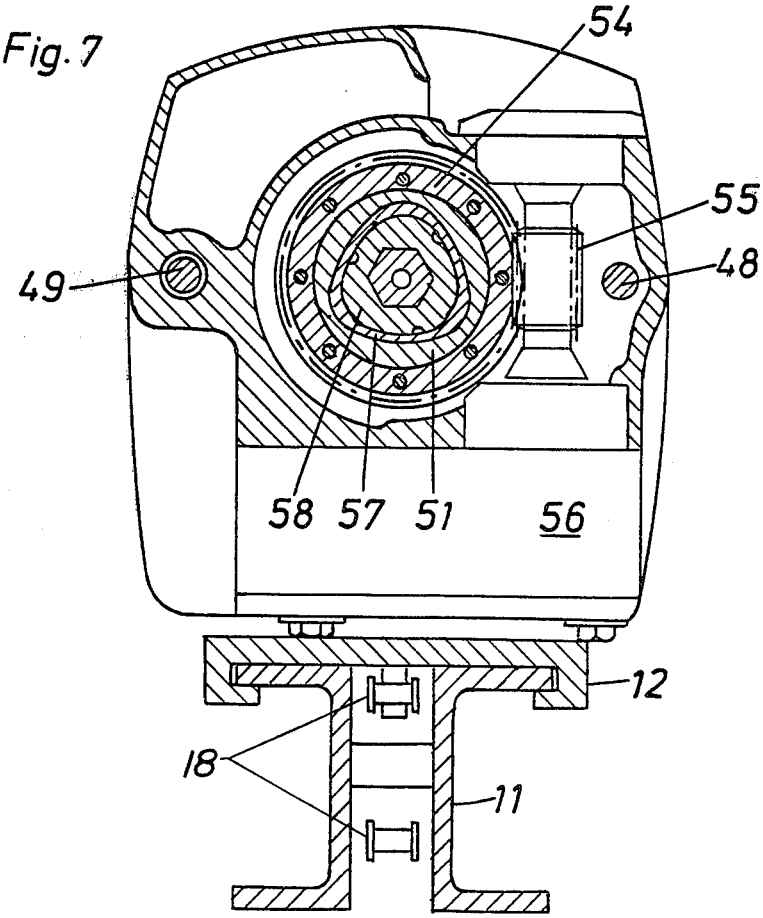
FIG. 7 is a transverse section taken along line 7—7 in FIG. 6.

When the machine is swung up as shown in FIG. 2, the entire front portion 46 of the housing with the rotation motor 56 and the worm gear 54, 55 can easily be replaced by removing the two screws 48, 49, FIG. 7. Since the worm gear 54, 55 is sealed off by means of a forward sealing ring 64 (FIG. 5) and rear sealing rings 65 that seal between the forward housing portion 46 and the drill sleeve 51, the entire gear box (i.e. the forward housing portion 46 with its content) is fully intact after being removed. Thus an operator can replace one gear box for an other without risking getting dirt into any one of the gear boxes.

Figure 8:
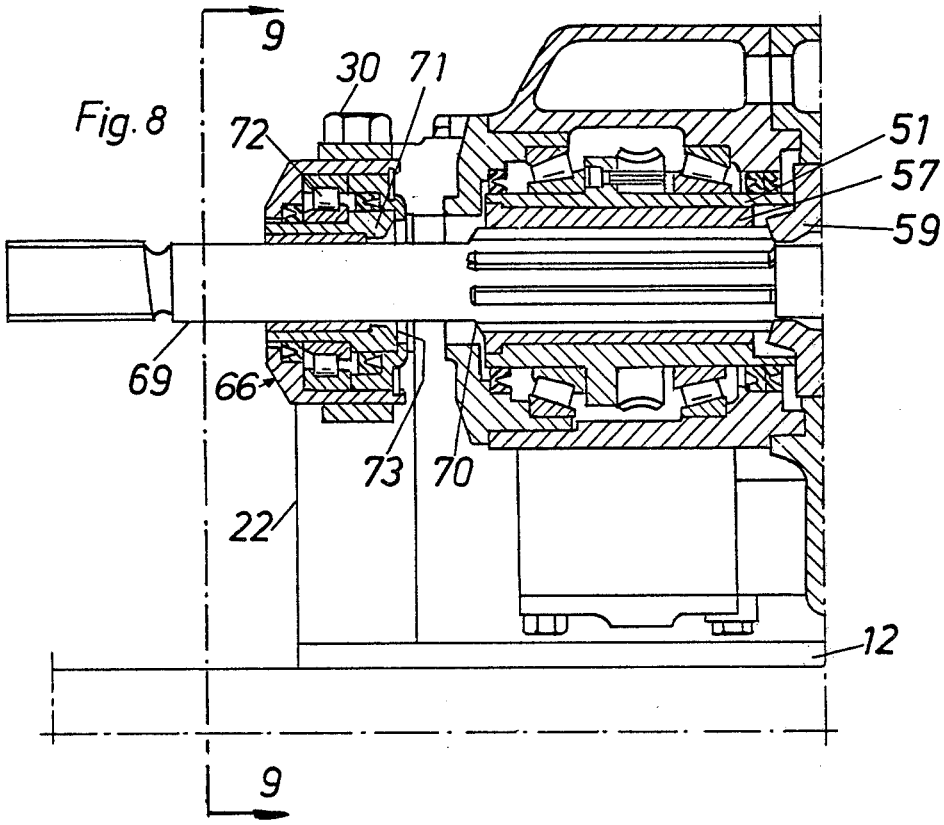
FIG. 8 is a longitudinal section corresponding to FIG. 5 but showing an alternative embodiment.
Figure 9:
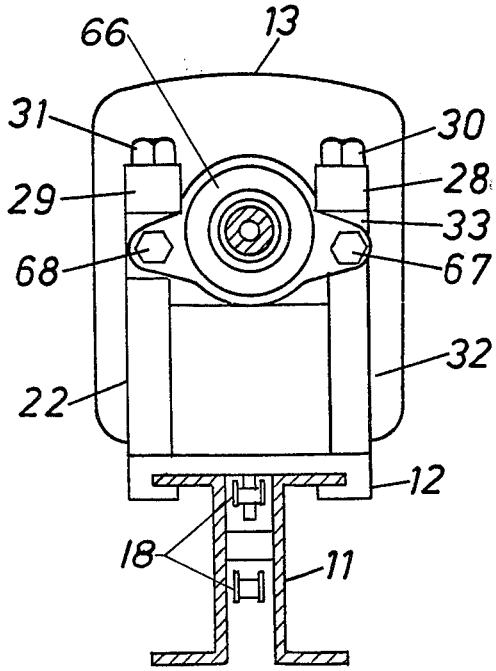
FIG. 9 is a transverse section taken along line 9—9 in FIG. 8.

In FIGS. 8 and 9 the drill and the forward bracket 22 are shown arranged for drilling by means of extension drill rods instead of integral drill rods. The upper portion 37 of the forward bracket 22 has been replaced by another upper portion 33 on which a bearing portion 66 is attached by means of two screws 67, 68. The bearing portion 66 has been put onto a conventional drill string adapter 69 that has an enlarged portion 70 that conveniently has the same outer form as the wear bushing 58 so that the same drill sleeve lining 57 can be used both for drilling with integral drill steels and with extension rods. The enlarged portion 70 of the adapter and the lining 57 is shown in FIG. 8 with a splined connection that can be used alternatively to the connection shown in FIGS. 5-7. The bearing portion 66 has a sleeve 71 that is rotatably mounted in a bearing 72 and this sleeve 71 has a rearwardly facing surface 73 that forms an abutment for the forward surface of the enlarged portion 70 of the adapter. The rear surface of the enlarged portion 70 of the adapter abuts against the piston 59.

What is claimed is:

1. Rock drilling apparatus comprising:

a feed beam (11);

a slide (12) axially displaceable along said feed beam;

a motor (19) coupled to said slide for axially displacing said slide along said feed beam;

a hammer drill (13) mounted to said slide (12) for axial displacement along said feed beam (11), said drill (13) being pivotably mounted at its rear end on said slide (12) by means of a transverse hinge connection (20-25);

said drill (13) comprising a housing having a main portion (45) in which an impact motor (50) is located and a detachable front portion (46) including a motor and gearing unit, said front portion being detachable from said main portion; said motor and gearing unit of said front portion including bearings (52,53) and sealing rings (64, 65) in front of and at the rear of said bearings, said sealing rings protecting said bearings also when the motor and gearing unit is detached from the remainder of said drill, said front portion (46) having a front aperture therein for receiving the rear end (36) of a drill string (75), the drill string (75) being freely insertable in and retractable out of said front aperture; and said slide (12) comprising retainer means (37, 38; 73) for preventing the drill string (75) from being pulled out of said drill.

2. Rock drilling apparatus according to claim 1, wherein said drill comprises a feed force transmitting supporting element (59) coupled to the drill string; and a drill sleeve (51) that is rotated by means of a drive motor (56) and is in form-locked engagement with a rotation transmitting element (58,70) for transmitting the rotation to the drill string, said rotation transmitting element being disposed in the drill sleeve and being axially slidable in the drill sleeve between a rear position abutting against said feed force transmitting supporting element and a forward position defined by said retainer means.

3. Rock drilling apparatus according to claim 2, wherein said drill string comprises a shank (36) and a collar (35), and said rotation transmitting element disposed in the drill sleeve (51) comprises a wear bushing (58), the inner surface of which is arranged to engage with the shank (36) of a drill string (75) and the front end face of which is arranged to constitute a rear support for the collar of the drill string, said retainer means (37, 38) forming a forward support for the collar.

4. Rock drilling apparatus according to claim 2, wherein said rotation transmitting element disposed in the sleeve comprises an enlarged portion (70) of a drill string adapter (69).

5. Rock drilling apparatus according to claim 2, wherein said feed force transmitting supporting element (59) is axially yieldably supported in the drill.

6. Rock drilling apparatus according to claim 1, wherein said drill comprises a mounting bracket (22) for carrying said retainer means (37,38).

7. Rock drilling apparatus according to claim 1, wherein the motor and gearing unit (46) comprises mounting means (28,29) adapted to be releasably attached to said slide (12) to form a forward support for the drill, said hinge connection (20-25) forming a rear support for the drill.

8. Rock drilling apparatus comprising:

a feed beam (11);

a cradle (12) mounted on said feed beam;

a motor (19) coupled to said cradle for axially feeding said cradle along said feed beam;

a percussion drill (13) mounted on said cradle, said drill having a chuck for receiving the rear end of a drill string (75), said drill string having a collar (35) thereon, a bushing (58) loosely fitted in said chuck and arranged to engage with said drill string and to transmit rotation from said chuck to said drill string, motor means (56) coupled to rotate said chuck, said bushing being freely insertable into and retractable out of said chuck, said bushing being adapted to axially support with its front end said collar of said drill string to transmit the feeding force from the drill to the drill string, a supporting element for axially supporting the rear end of said bushing, said supporting element being elastically yieldably supported in the drill; and upstanding rigid bracket means on said cradle having an axial opening through which the drill string is insertable into said chuck bushing, said bracket means forming an axial abutment for the collar of said drill string and an axial abutment for said chuck bushing, said axial abutments of said bracket means preventing the drill string and the bushing from being drawn out of the drill.

9. Rock drilling apparatus according to claim 8, wherein said drill (13) is pivotably mounted at its rear end to said cradle (12) and releasably affixed at its front and to said upstanding rigid bracket means of said cradle so that the front end of said drill can be swung up from said cradle about said pivotably mounted rear end in order to facilitate replacement of said bushing

10. Rock drilling apparatus comprising:

a feed beam (11);

a cradle (12) mounted on said feed beam;

a motor (19) coupled to said cradle for feeding said cradle along said feed beam;

a percussion drill (13) mounted on said cradle, said drill having a chuck for receiving the rear end of a drill string (75), said drill string having a collar (35)

thereon, a bushing (58) loosely fitted in said chuck and arranged to engage with said drill string and to transmit rotation from said chuck to said drill string, motor means (56) coupled to rotate said chuck, said bushing being freely insertable into and retractable out of said chuck, said bushing being adapted to axially support with its front end said collar of said drill string to transmit the feeding force from the drill to the drill string;

said cradle having a pivot mounting for the rear end of said drill and upstanding bracket means to which the front end of the drill is releasably affixed, said upstanding bracket means including axial abutment means for said bushing for preventing said bushing from falling out of or from being drawn out of said drill when said drill is affixed to said upstanding bracket means but for permitting replacement of said bushing when said drill is released from said bracket means and swung in its rear pivot mounting.

11. Rock drilling apparatus according to claim 10, wherein said drill is swingable upwardly from said cradle about said pivot mounting at its rear end in order to facilitate replacement of said bushing.

12. Rock drilling apparatus according to claim 10, wherein said cradle comprises further upstanding bracket means located at the rear end of said drill and carrying said pivot mounting for the rear end of said drill.

* * * * *